United States Patent [19]

Stewart et al.

[11] 4,323,240

[45] Apr. 6, 1982

[54] BOWLING GAME

[76] Inventors: Charles G. Stewart; Nellie R. Stewart, both of 8465 Village Dr.; Floyd E. Hicks; Maxine Hicks, both of 43 New Uri, all of, Florence, Ky. 41042

[21] Appl. No.: 179,776

[22] Filed: Aug. 20, 1980

[51] Int. Cl.[3] ..... A63F 7/06; A63F 3/06

[52] U.S. Cl. ..... 273/85 R; 273/144 A; 273/269; 273/277

[58] Field of Search ..... 273/144R, 144 A, 144 B, 273/148 R, 244, 277, 85 R, 146, 269; 235/90

[56] References Cited

U.S. PATENT DOCUMENTS

| | | | |
|---|---|---|---|
| D. 217,624 | 5/1970 | Rushing, Jr. | D3/78 |
| D. 223,768 | 6/1972 | Anti | D21/28 |
| D. 254,142 | 2/1980 | Scherotto | D21/41 |
| 658,316 | 9/1900 | Dooley et al. | 235/90 U X |
| 1,061,999 | 5/1913 | Grondahl | 273/269 |
| 1,661,711 | 3/1928 | Vaughan | D92/1 K |
| 2,368,896 | 2/1945 | Stewart | 273/273 |
| 3,841,260 | 10/1974 | Sharp et al. | 235/90 |

FOREIGN PATENT DOCUMENTS

| | | | |
|---|---|---|---|
| 480957 | 2/1952 | Canada | 273/146 |
| 504003 | 4/1939 | United Kingdom | 273/277 |
| 899630 | 6/1962 | United Kingdom | 273/144 A |
| 1218055 | 1/1971 | United Kingdom | 273/144 A |

*Primary Examiner*—Richard J. Apley
*Assistant Examiner*—Arnold W. Kramer
*Attorney, Agent, or Firm*—Wood, Herron & Evans

[57] ABSTRACT

A game is disclosed in which each of a group of players is provided with a color-coded scorecard. The format of each color-coded scorecard is similar to the format of a scoresheet for scoring a game of bowling. A caller is provided with a bin filled with ten tokens of each color. Each token of the same color is numbered with one of the numerals "1" to "10". The caller randomly selects tokens from the bin and calls the color and number of each token. If the color called corresponds to the color of his color-coded scorecard, the player writes the number called as the first or second ball in a frame of one game on his scorecard. Play ends when one player completes all frames of a game, whereupon all other players complete unscored and partially scored frames by marking gutter balls. Thereafter, each player totals his score for the game in accordance with the rules of bowling. The player with the highest score wins the game. The caller is also preferably provided with a tot board and pegs. The caller inserts a peg into a hole in the tot board for recording the color and number of each token called as the game is played so that players' scorecards can be verified. Other features are also disclosed.

3 Claims, 5 Drawing Figures

BOWLING GAME

BACKGROUND OF THE INVENTION

This invention relates to recreational and educational games played by a group of players and, more particularly, to a bowling game which does not require the equipment, for example, a bowling alley, bowling ball, and other bowling accessories, such as bowling shoes, or even the physical ability needed in the sport of bowling but which provides a leisure activity, especially for persons interested in the sport of bowling. Specifically, the invention is directed to a game which is related to lotto or bingo insofar as the procedure for playing the game is concerned but which is scored in accordance with the rules of bowling.

The sport of bowling has become very popular. Although some physical dexterity is required to become accomplished at the sport, persons of all ages and physical abilities bowl for recreation and amusement. Bowling is said to be a family sport, and all generations can enjoy the sport.

Unfortunately, the sport of bowling can be relatively expensive in terms of lane fees and equipment costs for persons who are interested in the sport only for recreation and amusement. Additionally, there are persons who become elderly or physically disabled who continue to be avid bowling enthusiasts but can no longer bowl. Furthermore, there is a need to educate youngsters or beginners with regard to how the sport of bowling is scored so that they will be able to score the game of bowling on their own without reliance on parents or friends.

SUMMARY OF THE INVENTION

One objective of the invention is to provide a bowling game which can be played by a group of persons without the expense of lane fees and equipment costs attendant to the sport of bowling.

Another objective is to provide a bowling game for persons who are interested in the sport of bowling but do not have the physical ability to engage in the sport.

An additional objective is to provide a bowling game for teaching persons how to score the game of bowling.

The primary objective, however, is to provide a bowling game which persons of all ages and physical abilities can play for recreation and amusement, especially those persons who are bowling enthusiasts.

The above objectives are achieved in accordance with a preferred embodiment of the invention which provides a bowling game related to lotto or bingo insofar as the procedure for playing the game is concerned. However, the bowling game is scored in accordance with the rules of bowling.

Each of a group of players is provided with a color-coded scorecard. The format of each color-coded scorecard is similar to the format of a scoresheet for scoring a game of bowling. A variety of different colored scorecards are preferably collated and bound together in pads distributed to the players.

A player or some other person is selected as the caller and is provided with a bin filled with tokens. The bin is preferably in the shape of a bowling ball. The bowling ball shaped bin is preferably rotatably mounted on a stand. The bowling ball shaped bin includes a trap door for depositing the tokens into the bin. The bowling ball shaped bin includes finger holes and a thumb hole, and the thumb hole is preferably provided with a cup means for automatically segregating a single token at random from the other tokens each time the caller rotates the bin.

There are ten tokens of each color. Each token of the same color is numbered with one of the numerals "1" to "10". Each of the tokens is preferably in the shape of a bowling ball having one of the numerals "1" to "10" in raised form on the token.

As the game is played, the caller randomly selects tokens from the bin and calls the color and number of each token. If the color called corresponds to the color of his color-coded scorecard, the player writes the number called as the first or second ball in a frame of one game on his scorecard. Play ends when one player completes all frames of a game. When play ends, all other players complete unscored and partially scored frames by marking gutter balls. Each player then totals his score for the game in accordance with the rules of bowling. The player with the highest score wins the game.

The caller is also preferably provided with a tot board and pegs. The caller inserts a peg into a hole in the tot board for recording the color and number of each token called as the game is played so that players' scorecards can be verified. The pegs are preferably in the shape of bowling pins adapted to be inserted into holes in the tot board.

The bowling game of the invention can be played by persons of all ages and physical abilities for recreation and amusement. The bowling game can also be used for teaching youngsters and beginners how to score the game of bowling.

BRIEF DESCRIPTION OF THE DRAWINGS

The above objectives and features of the bowling game of the invention will be better understood, and the concomitant advantages will be better appreciated by those skilled in the art after consideration of a description of the preferred embodiment of the bowling game in accordance with the invention which is given below in conjunction with the accompanying drawings. In the drawings.

DESCRIPTION OF THE PREFERRED EMBODIMENT

Figure 1:
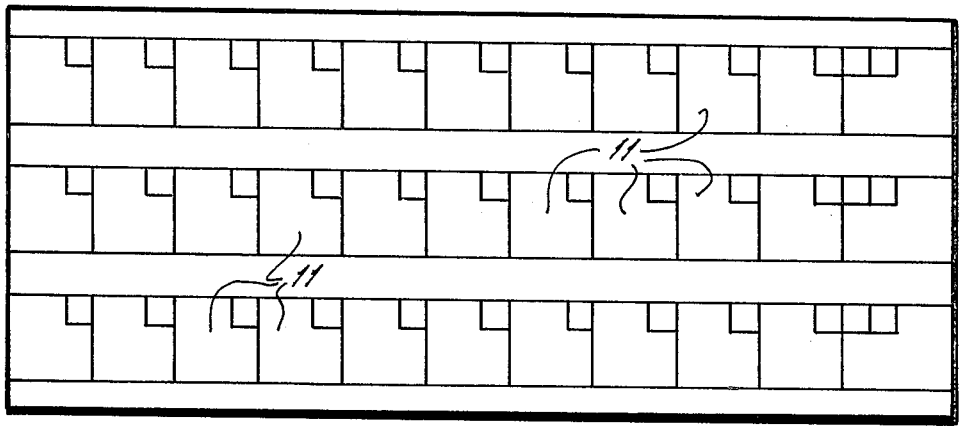
FIG. 1 shows a player's scorecard used for scoring the bowling game of the invention.

The preferred embodiment of the bowling game in accordance with the invention is played by a group of players. Each player receives a color-coded scorecard generally indicated in the drawings by the numeral 10. Scorecard 10 has a format shown in FIG. 1 which is similar to the format of a scoresheet for scoring a game of bowling. Each scorecard 10 is preferably printed in one of a variety of different colors, namely, black, red, blue, green, silver, orange, pink, purple, etc. However, each scorecard 10 could be printed in the same color of ink on one of a variety of different colors of paper. A number of scorecards 10 printed in different colors or printed on different colors of paper may be collated and bound in pads distributed to the players.

Preferably, each scorecard 10 is printed on both sides so that three separate games can be scored on each side of the scorecard. Scorecard 10 may measure 3½ inches by 8½ inches. Each side of scorecard 10 may include three rows of blocks 11 printed on the scorecard. As shown in FIG. 1, each row of blocks 11 preferably includes ten blocks which may measure ¾ inch by ¾ inch and an eleventh block which may measure ¾ inch by 1 inch. Each row of blocks 11 is for scoring a single game. Each player is also provided with a writing implement, such as a pen, for scoring a game on his scorecard 10.

In accordance with the procedure for playing the bowling game of the invention, one of the players is designated as the caller, or a person not among the group of players is selected as the caller. The caller follows a procedure similar to the procedure followed by the caller in lotto or bingo.

Figure 2:
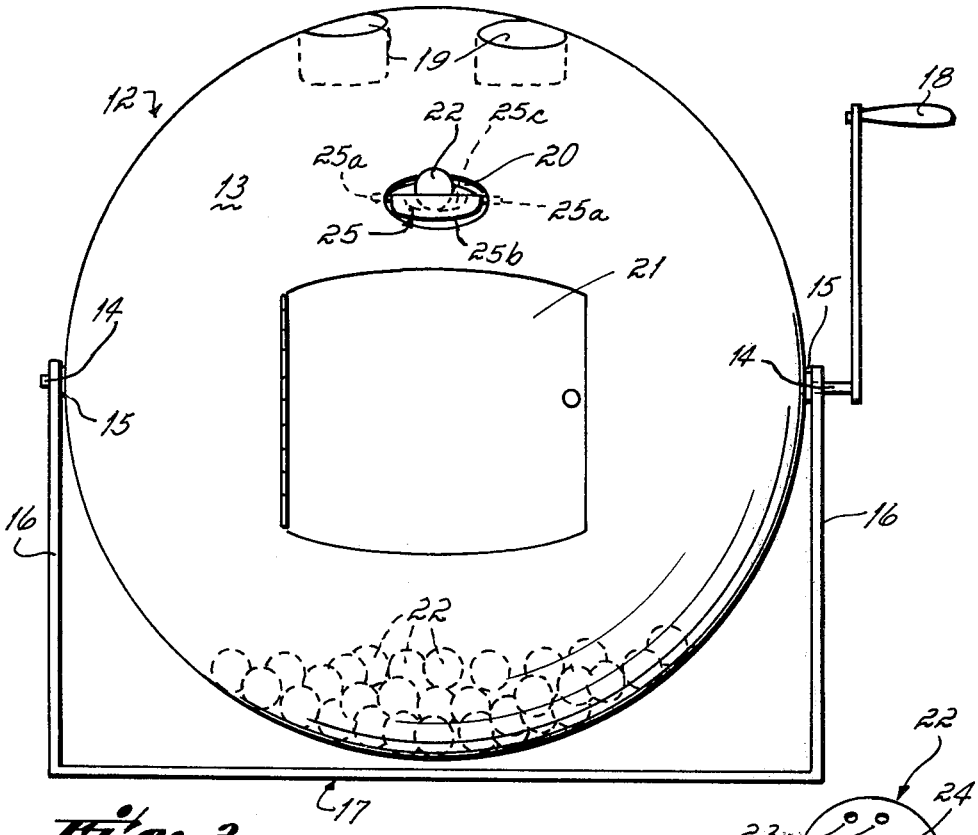
FIG. 2 shows a bin for randomly selecting tokens which are called by the caller as the bowling game of the invention is played.

The caller is provided with a bin generally indicated in the drawings by the numeral 12. As shown in FIG. 2, bin 12 preferably includes a shell 13 in the shape of a bowling ball. Preferably, half axles 14 are mounted at diametrically opposite points on shell 13, and the half axles are in turn rotatably supported by bearing surfaces 15 formed in flanges 16 of a stand 17 so that the shell is rotatably mounted on the stand. Preferably, one of the half axles 14 connects to a crank handle 18 which the caller turns for rotating bin 12.

In order to more effectively portray the appearance of a bowling ball, finger holes 19 and a thumb hole 20 are preferably formed in shell 13 of bin 12 as shown in FIG. 2. A trap door 21 which preferably measures 2½ inches by 3½ inches is provided in shell 13 for depositing tokens generally indicated in the drawings by the numeral 22 into bin 12.

The caller is provided with ten tokens 22 in each of the variety of different colors of print or paper used for constructing scorecards 10. Each of the ten tokens 22 of the same color is numbered with one of the numerals "1" to "10".

Figure 3:
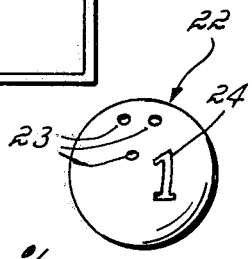
FIG. 3 shows a token deposited into the bin illustrated in FIG. 2.

As shown in FIG. 3, each token 22 is preferably in the shape of a bowling ball. Each token 22 is preferably a ½ inch sphere having depressions 23 which represent finger holes and a thumb hole. Alternatively, three dots may be painted on each token 22 for representing finger holes and a thumb hole. Preferably, each token 22 has one of the numerals "1" to "10" in raised form on the token as indicated by the numeral 24 in FIG. 3.

Bin 12 preferably includes a cup means 25 for randomly selecting a single token 22 each time the caller turns crank handle 18 after the tokens are deposited through trap door 21 into the bin. As shown in FIG. 2, cup means 25 is preferably swingably mounted in thumb hole 20. Cup means 25 includes arms **25*a* rotatably mounted in the walls of thumb hole 20. The base 25*b* of cup means 25 is relatively heavy compared with the hollow interior of the cup 25*c* formed in the top of the cup means. Consequently, cup 25*c* always opens upwardly since gravity acts to stabilize the heavier base 25*b* in the attitude shown in FIG. 2. Cup 25*c* is sized for automatically segregating a single token 22 as the cup passes beneath the tokens during rotation of bin 12 when the caller turns crank handle 18**.

Figure 4:
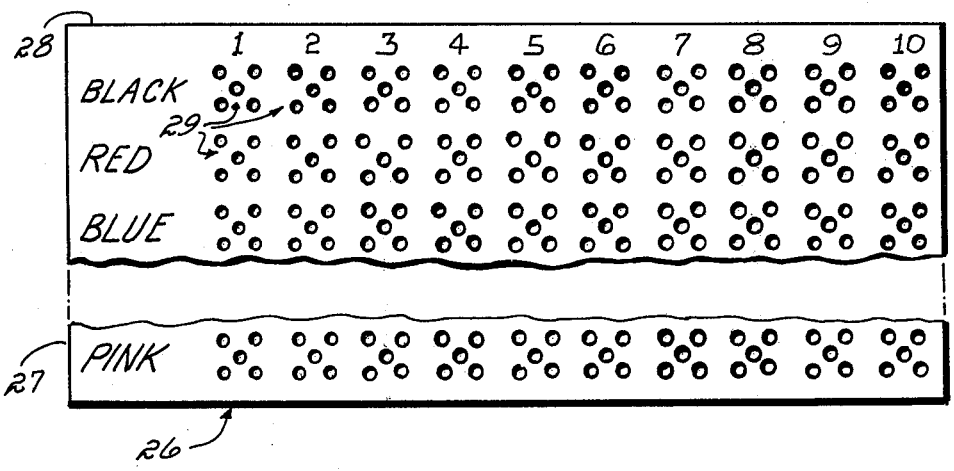
FIG. 4 shows a tot board used by the caller for recording the color and number of each token called as the bowling game of the invention is played so that players' scorecards can be verified.

Preferably, the caller is further provided with a tot board generally indicated in the drawings by the numeral 26. As shown in FIG. 4, tot board 26 has the variety of different colors of print or paper used for constructing scorecards 10 printed along one edge 27 and the numerals "1" to "10" printed along a perpendicular edge 28. Opposite each color and each one of the numerals "1" to "10" are holes 29. There may be, for example, five holes 29 in tot board 26 opposite each color and each one of the numerals "1" to "10".

Figure 5:
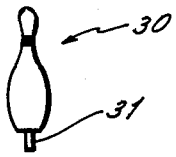
FIG. 5 shows a peg used by the caller for recording the color and number of each token on the tot board illustrated in FIG. 4.

The caller is further provided with a number of pegs generally indicated in the drawings by the numeral 30 adapted to be inserted into holes 29 in tot board 26 for recording the color and number of each token 22 called as the bowling game of the invention is played so that players' scorecards 10 can be verified. As shown in FIG. 5, each peg 30 is preferably in the shape of a bowling pin having a stub 31 adapted to be inserted into a hole 29 in tot board 26.

Broadly, the bowling game of the invention is related to lotto or bingo insofar as the procedure for playing the game is concerned. However, the bowling game is scored in accordance with the rules of bowling. As the game is played, the caller randomly selects tokens 22 from bin 12 and calls the color and number of each token. Each time that the color called corresponds to the color of his color-coded scorecard 10, the player writes the number called as the first or second ball in a frame of one game on his scorecard. Play ends when one player completes all frames of a game, whereupon all other players complete unscored and partially scored frames by marking gutter balls. Thereafter, each player totals his score for the game in accordance with the rules of bowling. The player with the highest score wins the game.

Several variations for playing the bowling game of the invention are contemplated. Before the caller calls the first color and number, for example, each player may be allowed to mark a strike anywhere in frames one to nine of one game on his scorecard. Thereafter, the caller randomly selects tokens 22 from bin 12 and calls out the color and number of each token.

Each time the caller calls the color which corresponds to his color-coded scorecard 10, the player preferably writes the number which is called as the first or second ball in any incomplete frame of the game on his scorecard. If the number "10" is called, the player marks a strike in a frame in which a number has not been previously entered. The total for the first and second ball in any frame is not allowed to exceed ten. The player marks a spare if the total equals ten. If a number cannot be used for the first or second ball in any frame without the total exceeding ten, the player must mark a gutter ball in one of the incomplete frames of the game on his scorecard.

Each player may be required to score the game on his scorecard in the order in which numbers are called rather than being able to choose any incomplete frame in which the number called can be scored. In that event, the player would be required to mark a gutter ball as the second ball if the second number called in a frame would cause the score for that frame to exceed ten.

The caller inserts a peg 30 into one of the holes 29 opposite the color and number printed on tot board 26 which corresponds to the color and number of each token 22 called. The caller then deposits each token 22 back into bin 12 so that the same color and number may be called again. If the same color and number are called more than five times, for example, which corresponds to the number of holes 29 opposite each color and number on tot board 26, the token may be retired rather than deposited back into bin 12.

When a player completes all frames, he voices his claim for a bonus, such as a twenty pin handicap for addition to his score. At that time, play ends, and each other player must mark a gutter ball as the first and/or second ball in the unscored and partially scored frames of the game on his scorecard. Each player then totals his score in accordance with the rules by which bowling is scored. The player with the highest score, which may not in fact be the first player to complete all frames, wins the game.

Several players could form a team, and the team with the highest cumulative score would win the game. Two players could alternate turns with the same color-coded scorecard as the game is played. Also, a series of three games, for example, could be played in order to determine the winner on a match basis.

The preferred embodiment of the bowling game in accordance with the invention provides recreation and amusement for persons of all ages. The bowling game can also serve as an educational tool for teaching youngsters and beginners how to score the game of bowling.

A preferred embodiment of the bowling game in accordance with the invention has been described by way of example and not by way of limitation. Various modifications will appear to those skilled in the art without departing from the scope or spirit of the invention. For example, a bottle or other suitable receptacle from which tokens are discharged singly and which may be in the shape of a bowling pin having a small hole in the neck could be used in lieu of the bowling ball shaped bin for randomly selecting tokens. Other modifications, especially variations in the rules for playing the bowling game of the invention, will occur to those skilled in the art and are considered to be within the scope and spirit of the invention. In order to ascertain the true scope of the invention, reference must be made to the appended claims.

We claim:

1. A bowling game comprising:

a variety of color-coded scorecards having a format similar to the format of a scoresheet for scoring a game of bowling, one of said scoresheets being distributed to each player among a group of players;

a number of tokens, ten of said tokens being colored each of said variety of different colors, each of said tokens of the same color being numbered with one of the numerals "1" to "10";

a bin into which said tokens are deposited for enabling a caller to randomly select said tokens from said bin for calling the color and number of each said randomly selected token;

whereby each time that the color called corresponds to the color of a player's scorecard, said player writes the number called as the first or second ball in a frame of one game on said player's scorecard, said game being ended when one player completes all frames of said game, all other players being required to complete unscored and partially scored frames by marking gutter balls, each player totaling the score of said game in accordance with the rules of bowling, so that the player with the highest score wins said game; and pegs and a tot board having holes into which said caller inserts said pegs for recording the colors and numbers of said randomly selected tokens as said game is played so that players' scorecards can be verified.

2. The bowling game of claim 1 wherein said pegs comprise bowling pin shaped pegs including stubs adapted to be inserted into said holes in said tot board.

3. A bowling game including the steps of:

distributing to a group of players a variety of different color-coded scorecards having a format similar to the format of a scoresheet for scoring a game of bowling;

depositing into a bin a number of tokens, ten of the tokens being colored each of the variety of different colors, each of the tokens of the same color being numbered with one of the numerals "1" to "10";

randomly selecting tokens from the bin for calling the color and number of each randomly selected token;

writing the number called as the first or second ball in a frame of one game on a player's scorecard when the color called corresponds to the color of the player's scorecard;

ending play when one player completes all frames of the game;

marking gutter balls in unscored and partially unscored frames of all other player's scorecards when play ends; and totaling the score of the game for each player in accordance with the scoring rules of bowling, so that the player with the highest score wins the game.

* * * * *

UNITED STATES PATENT AND TRADEMARK OFFICE

CERTIFICATE OF CORRECTION

PATENT NO. : 4,323,240

DATED : April 6, 1982

INVENTOR(S) : Charles G. Stewart et al

It is certified that error appears in the above—identified patent and that said Letters Patent is hereby corrected as shown below:

In column 5, line 47, "scoresheets" should be --scorecards--.

Signed and Sealed this

Sixth Day of July 1982

[SEAL]

*Attest:*

GERALD J. MOSSINGHOFF

*Attesting Officer*

*Commissioner of Patents and Trademarks*